United States Patent [19]

Ghafourian

[11] Patent Number: 4,464,547

[45] Date of Patent: Aug. 7, 1984

[54] TAP CHANGING MECHANISM

[75] Inventor: Ali A. Ghafourian, Zanesville, Ohio

[73] Assignee: McGraw-Edison Company, Rolling Meadows, Ill.

[21] Appl. No.: 414,872

[22] Filed: Sep. 3, 1982

[51] Int. Cl.[3] ..... H01H 3/00

[52] U.S. Cl. ..... 200/17 R

[58] Field of Search ..... 200/11 J, 11 TC, 17 R, 200/18, 161; 323/43.5; 361/339; 74/470, 502, 506

[56] References Cited

U.S. PATENT DOCUMENTS

| | | | |
|---|---|---|---|
| 924,295 | 6/1909 | Tomschik | 200/11 J |
| 2,811,595 | 10/1957 | Baguhn | 200/17 R |
| 2,817,247 | 12/1957 | Weinfurt et al. | 74/470 X |
| 3,167,703 | 1/1965 | Schindler | 323/43.5 |
| 3,875,354 | 1/1975 | Dusek | 200/11 TC |
| 4,317,160 | 2/1982 | Tillson et al. | 361/339 |

*Primary Examiner*—J. R. Scott

*Attorney, Agent, or Firm*—Jon C. Gealow; James A. Gabala; C. W. MacKinnon

[57] ABSTRACT

A mechanism is provided for operating an electrical switch of the type having a set of contacts electrically connected to the tapped windings of an inductor or transformer, and a tap changing mechanism for electrically connecting various contacts in response to the rotation of a shaft. The electrical switch is mounted onto the base of the inductor or transformer and the operating shaft of the switch is connected to a flange wheel. Another flanged wheel carried by the base, is in connection with a prime mover on the exterior of the transformer or inductor. One or two bowden cables are connected between the two flanged wheels with the outer portions of the bowden cable held fixed relative to the base and the inner portion of the bowden cable connected to the flanged portion of the wheels in such matter that relative motion between the inner and outer portions of the bowden cable induces rotation of the wheels. Thus, the switch is rotated in direct response to the prime mover.

16 Claims, 4 Drawing Figures

TAP CHANGING MECHANISM

TECHNICAL FIELD

This invention relates, in general, to electrical inductive apparatus such as transformers, and, more particularly, to these transformers and inductors having a tapped set of windings and a switch for changing the turns ratio between primary and secondary windings of the transformer so as to change the input or output voltage of the transformer.

BACKGROUND OF THE INVENTION

Tap changers of various designs are well known in the electrical industry. Conventional tap changing mechanisms include a plurality of stationary contact structures which are electrically connected to the tapped windings of the transformer, and a movable contact assembly which may be moved to engage the various stationary contacts. Thus, repositioning the movable contact assembly changes the turns ratio between the windings of the transformer. In the case a 3-phase transformer each phase of the transformer is provided with a separate set of stationary and movable contacts. The movable contacts are usually connected together by a common drive means which causes them to operate in synchronism with each other.

Various means have been used to operate or drive the set of movable contacts. U.S. Pat. Nos. 868,968 and 2,817,247 used a worm gear drive. U.S. Pat. No. 924,295 used a wheel and chain arrangement. U.S. Pat. No. 3,875,354 used a motor and chain drive. A combination of worm gear drive and bell crank is illustrated in U.S. Pat. No. 4,035,717. U.S. Pat. No. 4,013,847 illustrates an arrangement wherein the moving contacts are operated by a rack and pinion. U.S. Pat. No. 3,167,703 used a flexible shaft. Somewhat more complicated arrangements are illustrated in U.S. Pat. Nos.: 1,759,834; 2,009,383; 2,073,579; 3,246,088; 3,247,333; and 3,396,248. Tap changing mechanisms constructed in accordance with the teachings of these earlier patents, often require elaborate coupling mechanisms to change the tap settings. For the most part, the connecting members must be large and rigid to insure proper alignment of the gear drives and to withstand the forces required to change all three phases simultaneously. It also should be clear that, by reducing the mass of metal used in the operating mechanism, the magnetization losses of the transformer will be minimized. Clearly the expense of these earlier schemes cannot be justified if a simpler, easier to operate and easier to maintain mechanism could be used.

In addition to the short comings just described, the overall size and weight of the transformer is increased when such mechanisms are used. The excess space requirements are illustrated by U.S. Pat. Nos.: 1,641,271; 1,641,294; 2,000,754; and 3,467,794.

Moreover, when the voltage of a given polyphase transformer is high and its power output large, the size of such transformers and their associated load tap changing mechanism tend to become intolerably large, often exceeding the size limitations for transportation by rail or truck. Therefor, a tap changing mechanism which is smaller and more economical would be especially desirable.

It also should be clear from an examination of these earlier patents, that the space arrangement between the operating shaft and the drive shaft of the mechanism is often restricted to multiples of 90° when beveled gears and worm gears are used to change the direction of shaft rotation. It would be desirable to have an operating mechanism wherein the axes of rotation would be arranged at angles other than 90° from the direction of rotation of the operating device. This would give the designer greater flexibility and would also reduce the overall size of the apparatus.

SUMMARY OF THE INVENTION

In accordance with the present invention, a tap changing mechanism is provided for operating an electrical switch of the type having a set of contacts electrically connected to the tapped winding of a transformer or inductor, a drive shaft, and means for electrically connecting together pairs of contacts in response to the rotation of the drive shaft. The electrical switch is supported by a base or frame which houses the transformer or inductor. An operating shaft is rotatably carried by the base or frame supporting transformer. The operating shaft is typically disposed at an angle relative to the first shaft or drive shaft of the electrical switch. The drive shaft is provided with a wheel means or device for operating the electrical switch. The wheel means defines two radially disposed arms. A second wheel means is carried by the operating shaft so as to amplify the arc through which the operating shaft is rotated. A conduit coupled cable means flexibly connects radially disposed portions of the first wheel means with radially disposed portions of the second wheel means. In one particular embodiment the conduit coupled cable means includes two generally hollow rigid bridging members or tubes, each of which has an end fixably connected to a portion of the base adjacent the first and second wheel means, and a flexible cable or wire housed within the tubes and connected to the first and second wheel means. Under this arrangement the bridging members or tubes guide or direct the force transmitted along the flexible cable or wire. Thus, the axes of the first and second wheel means need not be parallel or intersecting or at multiples of 90° from each other.

In one embodiment a pair of flanged pulleys are used for the first and second wheel means. In addition the conduit coupled cable means is formed from a pair of bowden cables. Each end of the interior wires of the bowden cables is connected to a flanged portion of the pulley. The ends of the wires are reeved or wrapped around a portion of the periphery of the pulley such that the application of tension causes the wheel means to rotate and the electrical switch to change postion.

The numerous advantages and features of the present invention will become readily apparent from the following detail description of the invention, from the embodiments illustrated, and from the claims.

DESCRIPTION OF THE PREFERED EMBODIMENT

Figure 1:
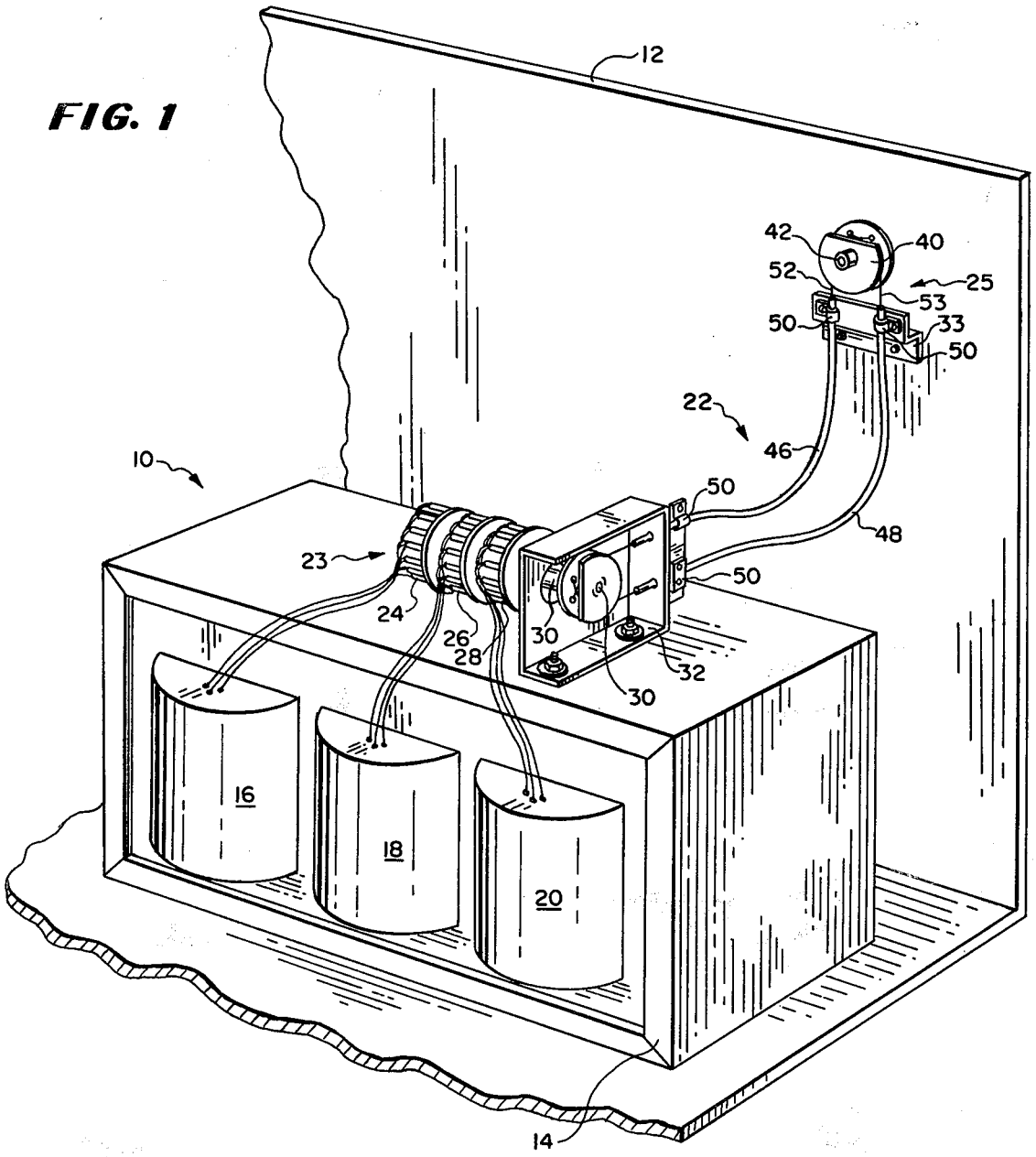
FIG. 1 is a pictorial cut away view of the inside or interior of a tank which houses the core and coils of a tapped transformer and the tap changing mechanism that is the subject of the present invention.

While this invention in susceptible of embodiment in many different forms, there are shown in the drawings, and will herein be described in detail, preferred embodiments of the invention. It should be understood, however, that the present disclosure is to be considered as an exemplification of the principles of the invention and it is not intended to limit the invention to the specific embodiments illustrated.

Figure 3:
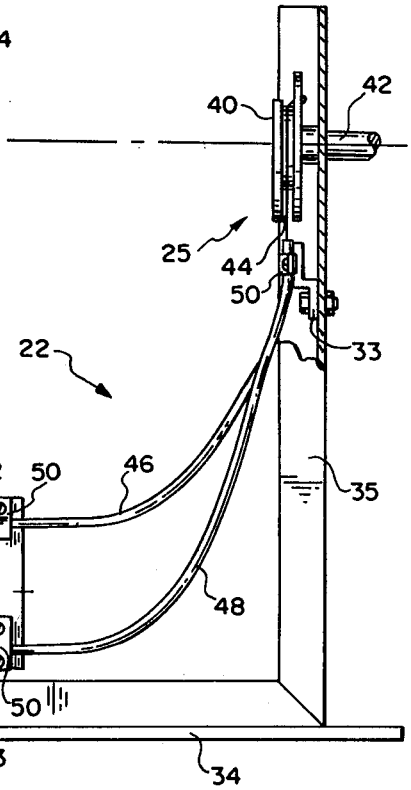
FIG. 3 is a side elevational view of the mechanism shown in FIG. 2.
Figure 4:
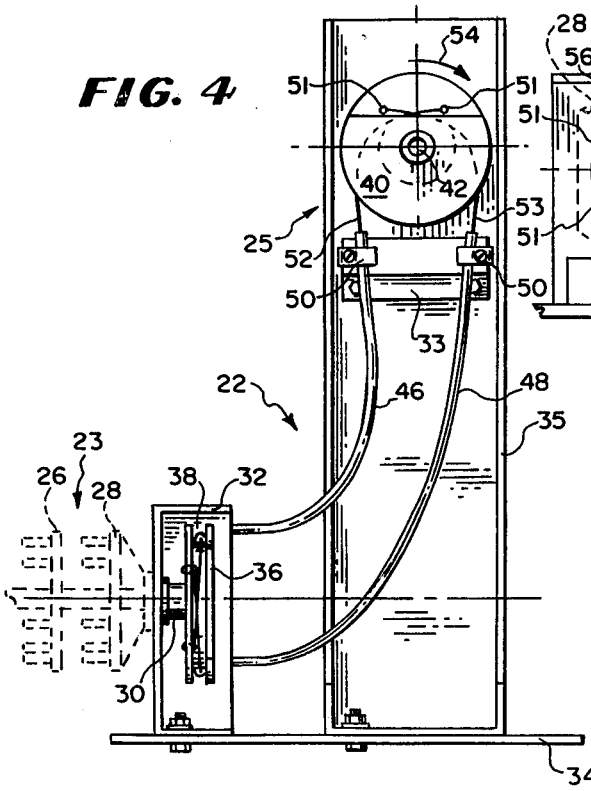
FIG. 4 is a front elevational view of a mechanism shown in FIG. 2.

Referring to FIG. 1 there is shown a 3-phase transformer 10 comprised of a sealed tank or enclosure 12 which surrounds a core and coil assembly 14 wherein phase windings 16, 18 and 20 are disposed in an inductive relationship to a 3-phase magnetic core. Also housed within the tank 12 is a tap changing mechanism 22 which is constructed in accordance with the teachings of the present invention. The tank 12 is filled with a suitable insulating dielectric fluid, such as transformer oil. Although not illustrated, for purposes of clarity and understanding the invention, the transformer tank 12 also supports a set of bushings for electrically connecting the windings 16, 18 and 20 of the transformer 10 to an external electrical network. The tap changing mechanism 22 includes an electrical switch portion or driven end 23 which, in the embodiment illustrated, is carried atop the core and coil assembly 14, and a operating portion or driving end 25 which is carried by the tank 12. The driven end 23 of the tap changing mechanism 22 includes three electrical switches 24, 26 and 28. Each electrical switch includes a set of fixed or stationary contacts and a movable contact element which is operated or rotated in response to rotation of a common drive shaft 30; as such, the three electrical switches are "ganged" together. Thus, the turns ratio of primary and secondary windings of the transformer are changed in response to the rotation of the drive shaft 30. A suitable bracket or fixture 32 is used to mount the three electrical switches to the core and coil assembly 14. The remaining portions of tap changing mechanism 22 are best explained with reference to FIGS. 2, 3 and 4.

Figure 2:
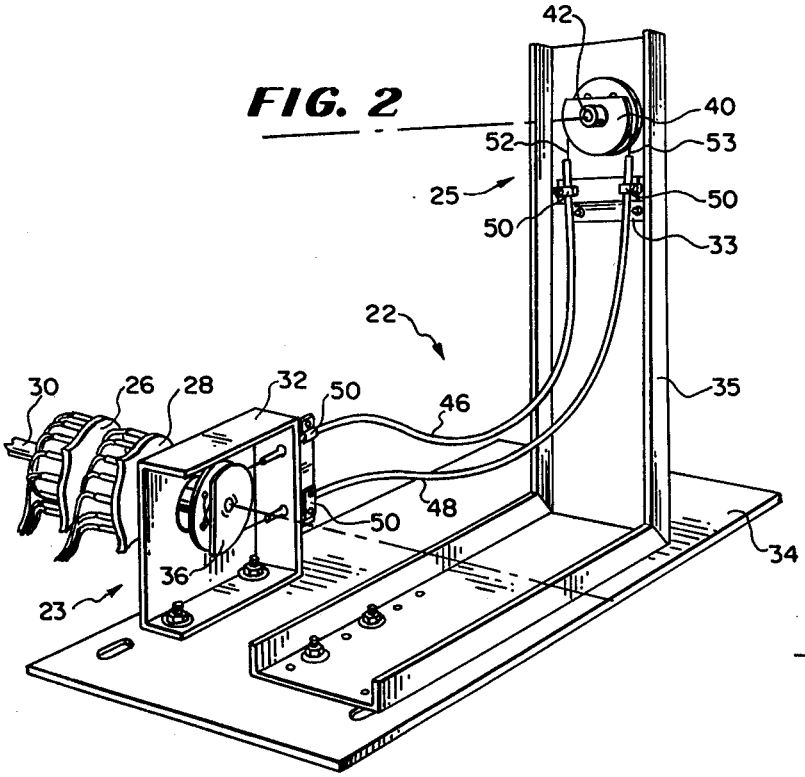
FIG. 2 is an enlarged view of the tap changing mechanism shown in FIG. 1 when supported on a test stand.

Referring to FIG. 2, for purposes of description, the two portions 23 and 25 of the tap changing mechanism 22 have been mounted on a common base or test stand 34. The test stand 34 includes a upper mounting bracket 35 which is used to correctly position the operating portion or driving end 25 in relationship to the bracket 32 which supports the electrical switch portion or driven end 23 of the tap changing mechanism 22.

Referring to the electrical switch portion 23, a flanged pulley or wheel 36 is keyed or fixed to one end of the drive shaft 30. The space between the two flanges and the hub of the pulley 36 forms an annular channel 38. A similar flanged pulley or wheel 40 is keyed to an operating shaft 42 which is rotatably mounted on the transformer tank (see FIG. 1) or on a vertical mounting bracket 35 affixed to the base of the test stand 34 (See FIGS. 2, 3, and 4). As in the case of the lower flanged pulley or wheel 36, the space between the two flanges and the hub of the upper pulley 40 defines an annular channel 44 (see FIG. 3). The operating shaft 42 would be connected to suitable prime mover such as an electrical motor or a handwheel or handle.

Spanning the distance between the two flanged wheels 36 and 40 are a pair of bridging members 46 and 48. The bridging members, in the embodiment illustrated, are formed from metal conduits or tubes, which carry a flexible inextensible connection means 52 and 53. The ends of each conduit 46, 48 are disposed generally tangent to the channels 38 and 44 defined by the two flanged wheels 36 and 40.

Turning first to the two conduit bridging members 46 and 48, each is bent to form a smooth, generally uniform arcuate path between the two flange wheels 36 and 40. Sharp bends are to be avoided. The path taken by the two conduits 46 and 48 generally takes in consideration the internal obstructions within the transformer tank 12, the preferred location of the handwheel or prime mover used to rotate the operating shaft 42. The bridging members 46 and 48 should be sufficiently rigid relative to the force or tension applied to the two connecting cables 52 and 53 that they are not unnecessarily disturbed or displaced. If necessary suitable restraints or brackets can be provided to hold the center portion of the conduits or bridging members 46 and 48 in place. In the particular embodiment illustrated, the two bridging members 46 and 48 transverse a path generally downwardly from one of the walls of the transformer tank 12 to a position towards the center of the tank. A support bracket 33 is used to hold the two ends of the bridging members 46 and 48 aligned with the channel 44 defined by the upper flanged wheel 40. In FIG. 1, the support bracket 33 is mounted onto the transformer tank 12. In the FIGS. 2, 3 and 4 the support bracket 33 is bolted onto the verticl mounting bracket 35 of the test stand 34. Suitable clamps 50 are provided to secure the ends of the conduits to the lower mounting bracket 32 for the electrical switch portion 23 and to the operating portion 25 of the tap changing mechanism 22. These clamps 50 securely hold the bridging members 46 and 48 fixed in place.

It should be emphasized that the device illustrated is an exemplification of the principles of the invention and that it is not intended to limit the invention to the specific arrangement illustrated in the drawings. Those skilled in the art will note that heretofore angular rotation of the operating shaft 42 was transmitted to the drive shaft 30 by means of beveled gears, worm gears, rack and pinion systems, sprockets and chains, and the like. Such rotation transmitting devices, for the most part, are restricted to multiples of 90° (i.e., the axes of the drive shaft 30 and the operating shaft 42 were either parallel or perpendicular to each other). Moreover, couplings, intermediate shafts, and universal joints were often necessary where the driving and driven components of the tap changing mechanism are spaced at relatively large distances from each other or if they were not in the same vertical or horizontal plane. Thus, the overall simplicity and economy of the present invention should be appreciated by those skilled in the art.

A flexible inextensible connection means 52, 53 is housed within each conduit bridging member or tube 46 and 48. The connection means may take on the form of a flexible wire or tape or a wire cable. Those skilled in the art will recognize the arrangement of a generally cylindrical flexible conduit in combination with a flexible inextensible wire or cable as forming what is often called a "bowden cable". Usually, the conduit or fixed portion of a bowden cable is formed from flat or round stiff steel wire which has been closely wound in the form of a helix so as to form a generlly inextensible spring or tube. Since the two ends of the bridging members 46 and 48 are held fixed in place by the clamps 50, the connection means 52 and 53 is free to move within the bridging members. The diameter of each connection means 52 and 53 is sufficiently small relative to the inside diameter of the associated bridging member 46, 48 such that relatively friction free translation is permitted.

Each end of each connection means 52, 53 is connected to or attached to one of the flanged wheels 36 and 40. In the embodiment illustrated in the drawings, one of the flanges is provided with two apertures 51 into which the ends of the connection means or cable are inserted. Preferably, the aperture to which the end of the connection means is inserted is at a sufficient distance from the end of the associated bridging member that the connection means is wrapped or reeved around or through the channel 38, 44 defined by the flanged wheel 36, 40. Thus the two ends of each cable 52, 53 assume a "criss-crossed" relationship (see FIG. 4 for the lower flanged wheel 36, in particular). This arrangement maximizes the arc through which the pulleys are rotated (i.e. the closer the aperture 51 to the end of the associated bridging member, the shorter the distance that the cable can be pulled). For convenience of connection, the flange opposite the one in which the cable or connection means is inserted is partially cut away. A convenient means for securing the free end of the cable once it has been inserted in the apertured portion of the flanged wheel is to crimp the end of the cable. Other methods should become apparent to those skilled in the art.

Now that the principal components of the invention have been described in detail, the overall operation of the device will be explained. Referring to the upper portion of FIG. 4, it should be clear that when the upper operating shaft 42 is rotated clockwise (see Arrow 54) the upper flanged wheel 40 will also rotate clockwise. The clockwise rotation of the flange to which the upper ends of the cables 52 and 53 are connected effectively pulls the upper end of cable 52. The motion of this cable is transmitted to the lower flanged wheel 36 which causes the lower drive shaft 30 to rotate clockwise (i.e. see Arrow 56 at the lower end of FIG. 3). This rotation of the drive shaft 30, in turn, changes the position of the three electrical switches 24, 26 and 28 which are ganged together. The clockwise rotation 56 of the lower flanged wheel 36 effectively pulls or drags the lower end of the other cable 53 out of the lower end of the other tube or conduit 48. Thus the rotation of the lower flanged wheel 36 is "fed back" to the upper flanged wheel 40, and the two cables are repositioned in anticipation of rotating the switches 24, 26, and 28 in the opposite direction. It should be clear from the foregoing that the arcuate distance through which the lower flanged wheel 36 rotates relative to the upper flanged wheel 40 will be the same if the radial distance and arcuate separation of the apertures 51 in the flanged wheels is the same. By varying the radial distance and the angular separation an "amplification" effect can be produced between the driving end 25 and the driven end 23 of the tap changing mechanism 22.

From the foregoing it will be observed that numerous variations and modifications may be effected without departing from the true spirit and scope of the novel concept of the invention. For example, it should be clear to those skilled in the art that the two ends 23 and 25 of the tap changing mechanism 22 can be electrically insulated from each other by using bridging members 46 and 48 and connecting means 52 and 53 which are non-electrically conducting (e.g. a nylon or plastic cable housed within an elastomeric conduit). By minimizing the components within the transformer which are subject to magnetization, the core losses of the transformer are minimized. It is to be understood that no limitation with respect to the specific apparatus illustrated is intended or should be inferred. It is, of course, intended to cover by the appended claims all such modifications as falls within the scope of the claims.

What is claimed is as follows:

1. Apparatus, comprising:

a. an electrical switch having a plurality of contacts, a first shaft, and means for electrically connecting together pre-selected contacts in response to the rotation of said first shaft in one direction, the rotation of said first shaft in the opposite direction having the effect of electrically disconnecting said contacts from each other;

b. a base for supporting said switch;

c. a second shaft rotatably carried by said base, and disposed at an angle relative to said first shaft;

d. first wheel means, carried by said first shaft, for rotating said first shaft, said first wheel means defining two radially disposed arms the lengths of which are greater than the radius of said shaft;

e. second wheel means, carried by said second shaft and defining two radially disposed arms the lengths of which are greater than the radius of said second shaft, for amplifying the arc length through which said second shaft is rotated; and f. conduit coupled cable means for flexibly connecting the radial arms of said first wheel means with the radial arms of said second wheel means, whereby said switch is operated in response to the rotation of said second shaft.

2. The apparatus set forth in claim 1, wherein said conduit coupled cable means includes two hollow generally rigid bridging members, each of which has:

an end fixedly connected to that portion of the base which is adjacent one of said radial arms on each of said first and said second wheel means; and a flexible stiff wire housed within each of said bridging members and connected to the adjacent radial arms on said first and second wheel means.

3. The apparatus as set forth in claim 1, wherein the axis of rotation of said first shaft is disposed generally at a right angle to the axis of rotation of said second shaft.

4. The apparatus set forth in claim 1, wherein said first wheel means is a wheel defining a hub and a peripheral flange.

5. The apparatus set forth in claim 1, wherein each of said wheel means is a flanged pulley, and wherein said switch is electrically connected at one end to the tapped winding of an inductor.

6. The apparatus as set forth in claim 1, further including a second electrical switch having at least two electrical contact elements, a third shaft coupled to said first shaft, and means for electrically connecting said two contact elements in response to the rotation of said third shaft in one direction, the rotation of said third shaft in the opposite direction having the effect of electrically disconnecting said two contact elements from each other, whereby said pre-selected contacts and said two contact elements are electrically connected and disconnected in response to the operation of said second shaft.

7. The apparatus set forth in claim 1, wherein said conduit coupled cable means is a pair of bowden cables.

8. A tap changing mechanism for a tapped winding of an inductor, comprising:

a. a main frame for carrying said inductor;

b. an electrical switch carried by said frame and having a plurality of electrical contacts at least one of which is electrically connected to said tapped winding, a first shaft, and means for electrically connecting preselected pairs of said contacts in response to the rotation of said first shaft, the rotation of said first shaft in the clockwise direction having the effect of electrically connecting at least one pair of contacts together and the rotation of said first shaft in the counter-clockwise direction having the effect of electrically disconnecting said one pair of contacts from each other;

c. a second shaft rotatably carried by said frame and disposed relative to said first shaft such that their axes of rotation do not lie in the same plane;

d. wheel means, carried by said first shaft, for rotating said first shaft;

e. amplifying means, carried by said second shaft, for amplifying the rotation of said second shaft, said amplifying means defining two radially disposed arms the lengths of which are greater than the radius of said second shaft;

f. two conduits disposed between said wheel means and said amplifying means and connected to said frame;

g. first flexible connection means, carried within one of said two conduits, for flexibly and inextensibly connecting together said wheel means with said amplifying means; and h. second flexible connection means, carried within the other of said two conduits, for flexibly and inextensibly connecting together said wheel means with said amplifying means, said first and second flexible connection means being connected to said wheel means at points defined by the diameter of said wheel means, whereby said switch is operated in response to the rotation of said second shaft.

9. The apparatus set forth in claim 8, wherein each of said first flexible connecting means and said second flexible connecting means defines an arcuate trajectory.

10. The apparatus set forth in claim 8, wherein said wheel means has a radius greater than the radius of said first shaft.

11. The apparatus set forth in claim 8, wherein said wheel means is a flanged pulley defining a hub and at least one flange, and wherein said first flexible connection means and said second flexible connection means are connected to said amplifying means in a criss-crossed relationship across said hub.

12. In an electrical switch for an inductor having at least two contacts, with at least one of the contacts electrically joined to said inductor; a first shaft; means for electrically connecting said contacts in response to the rotation of said first shaft; a base for supporting said switch; and first wheel means, operatively connected to said first shaft and defining two radially disposed arms, for rotating said first shaft, an operating mechanism comprising:

a. second wheel means, rotatably carried by said base and defining two radially disposed legs; and b. a pair of bowden cables for flexibly connecting said radial arms with said radial legs, each of said bowden cables defining an outer portion whose ends are fixed relative to said base and an inner portion which is free to move within said outer portion, said inner portion defining two ends, one of which is connected to one of said arms and the other one of which is connected to one of said legs, whereby said switch is operated in response to the rotation of said second wheel means.

13. The apparatus set forth in the claim 12, wherein said first wheel means defines two radial arms whose lengths are greater than the radius of said first shaft, and wherein said second wheel means defines two radial legs whose lengths are at least equal to the radius of said radial arms.

14. The apparatus set forth in claim 12, wherein the axes of said first shaft and said second wheel means are non-parallel and non-intersecting.

15. The apparatus set forth in claim 14, wherein said axes lie within two planes disposed generally perpendicular to each other.

16. The apparatus set forth in claim 12, wherein one of said first and second wheel means is a flanged pulley defining a annular channel, and wherein at least one of said inner portions of said bowden cables is connected to said flanged pulley in such a manner that it is disposed arcuately within said recess throughout the rotation of said second wheel means.

* * * * *